US011382403B2

(12) United States Patent
Gantz et al.

(10) Patent No.: US 11,382,403 B2
(45) Date of Patent: Jul. 12, 2022

(54) WEARABLE CARRYING SYSTEM

(71) Applicant: UBAVU, LLC, Northbrook, IL (US)

(72) Inventors: Christopher Gantz, Northbrook, IL (US); Russ Knize, St. Charles, IL (US)

( * ) Notice: Subject to any disclaimer, the term of this patent is extended or adjusted under 35 U.S.C. 154(b) by 0 days.

(21) Appl. No.: 17/068,411

(22) Filed: Oct. 12, 2020

(65) Prior Publication Data

US 2021/0106126 A1 Apr. 15, 2021

Related U.S. Application Data

(60) Provisional application No. 62/913,374, filed on Oct. 10, 2019.

(51) Int. Cl.

| | |
|---|---|
| ***A45F 3/20*** | (2006.01) |
| ***A45F 3/04*** | (2006.01) |
| ***A45F 3/12*** | (2006.01) |
| ***A45F 3/14*** | (2006.01) |
| ***A45F 3/02*** | (2006.01) |
| ***A45F 3/00*** | (2006.01) |

(52) U.S. Cl.

CPC ..... *A45F 3/20* (2013.01); *A45F 3/02* (2013.01); *A45F 3/04* (2013.01); *A45F 3/12* (2013.01); *A45F 3/14* (2013.01); *A45F 2003/001* (2013.01)

(58) Field of Classification Search

CPC ..... A45F 3/20; A45F 3/04; A45F 3/12
USPC ..... 224/643, 642, 153
See application file for complete search history.

(56) References Cited

U.S. PATENT DOCUMENTS

| | | | | |
|---|---|---|---|---|
| 3,883,053 | A * | 5/1975 | Pritchard | A45F 3/12 297/483 |
| 6,223,959 | B1 * | 5/2001 | Chen | A45F 3/12 224/264 |
| D448,170 | S * | 9/2001 | Ammerman | D3/327 |
| 6,678,895 | B1 * | 1/2004 | Grilliot | A41F 15/007 2/268 |
| 6,915,932 | B1 * | 7/2005 | Wolfe | A45F 3/12 224/264 |
| 9,204,708 | B2 * | 12/2015 | Fidrych | A45F 3/12 |
| 10,238,918 | B1 * | 3/2019 | Huot | A45F 3/04 |
| 2004/0060951 | A1 * | 4/2004 | Kelly | A45F 3/12 224/264 |
| 2004/0144816 | A1 * | 7/2004 | Ku | A45F 3/12 224/264 |
| 2006/0175367 | A1 * | 8/2006 | Khorshid | A45F 3/042 224/264 |
| 2007/0056779 | A1 * | 3/2007 | Laniado | E04H 4/06 177/245 |
| 2008/0296328 | A1 * | 12/2008 | Wu | A45F 3/08 224/263 |
| 2013/0153614 | A1 * | 6/2013 | Wetzsteon | A45F 3/12 224/264 |

* cited by examiner

*Primary Examiner* — Nathan J Newhouse
*Assistant Examiner* — Lester L Vanterpool
(74) *Attorney, Agent, or Firm* — Howard B. Rockman

(57) ABSTRACT

A wearable carrying system for a container such as a backpack or a bag has one or two straps that extend over the shoulder(s) and torso of a user. The strap or straps include a bladder system that is sequentially inflated or deflated by the controllable introduction and removal of a fluid into and out of the bladder system. A shoulder pad is located on a portion of the strap, the shoulder pad having an additional controllable bladder system to adjust the load bearing position of a strap on the shoulder of a user.

5 Claims, 16 Drawing Sheets

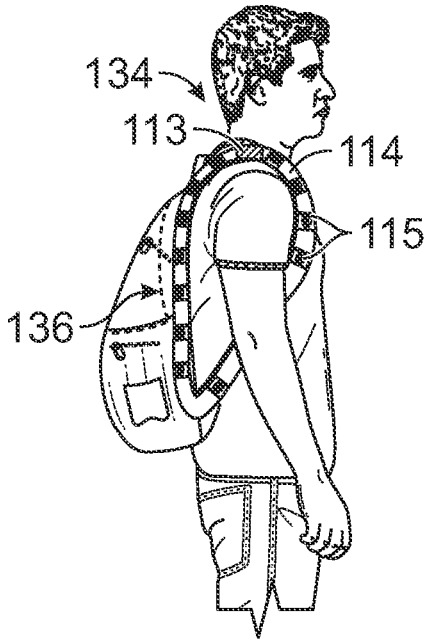
FIG. 5
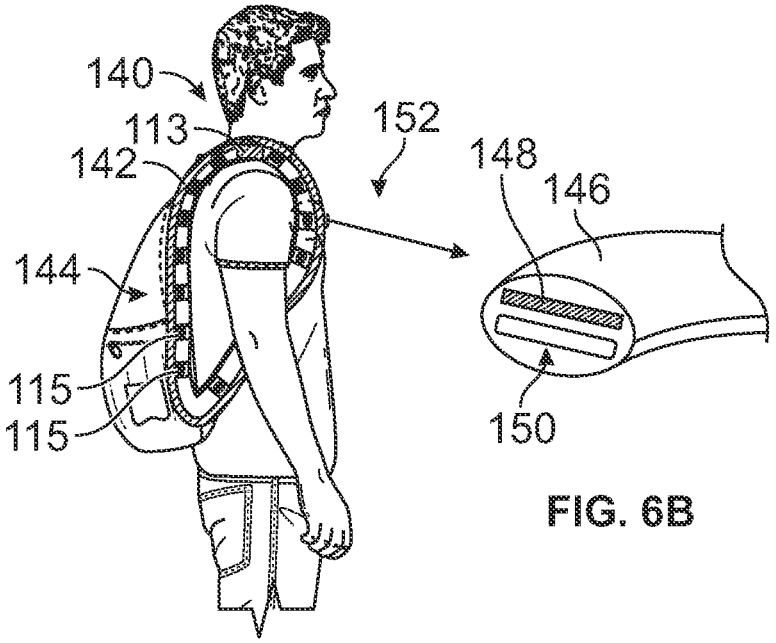
FIG. 6B
FIG. 6A

| AI Processor General Data Input |
|---|
| **A. Key Human Programmables (Input to AI Controller)** |
| 1 Users Height |
| 2 Users Weight |
| 3 Users Build |
| 4 Exercise Routine |
| 5 Medical Conditions / Body Mass Index / Colds... |
| 6 Endurance Performance Previous Outings |
| 7 Heart Rate / Heart Conditioning |
| 8 Shoulder Width and Depth Measurement (Pack Straps) |
| 9 Core Dimensions (Breast, Waist, Hips, Biceps, Legs...) |
| 10 Noursiment Data - Last Meal, Caloric Intake, Hydration Levels |
| 11 Sleep (Previous 24 Hours) |
| 12 Medical Precaution / MD Instructions / Medications |
| 13 Alcohol Consumption (Previous 24 Hours) |

| **B. Key Ambient Factors (Input from Sensors, Internet, Mobile Phone)** |
|---|
| 1 Current Air Temp |
| 2 Weather Condition |
| 3 Humidity |
| 4 Forecasted Weather (Cloudy, Sunny, Rain) - ( Noaa Feed) |
| 5 Event Altitude |
| 6 Typical Altitude (Human Home) |
| 7 Time of Day |

FIG. 20

| C. Key Journey Programables |
|---|
| 1 General Terrain - User Input |
| 2 Incline - User Input (Trail Dependent) |
| 3 Topo - GPS Data (Over Anticipated Route) |
| 4 Anticipated Weather (Remote Data) |
| 5 Pack Weight |
| 6 Last Hike (Data, Conditions, Performance) |

FIG. 20
(Continued)

| AI Processor Output Primary Pack Functionality |
|---|
| 1 Strap Shoulder Load Shifting |
| 2 Strap Torso Load Shifting |
| 3 Trek Pacing Guidance |
| 4 Human Bio Monitoring |
| 5 Hydration Monitoring and Recommendation |
| 6 Hydration Distribution |
| 7 Resting Period Recommendation |

FIG. 21

WEARABLE CARRYING SYSTEM

This application claims priority to provisional patent application Ser. No. 62/913,374, filed Oct. 10, 2019, to the extent allowed by law.

The present invention relates to wearable carrying system, and particularly to shoulder and torso mounted carrying bags, backpacks and the like, that includes straps and an artificial intelligence based automatic adjusting strap system.

Students, hikers, commuters, travelers, soldiers and virtually anyone wearing a backpack or a side-of-the-torso mounted carrying bag will utilize a system of load bearing straps to support the load of the pack or bag they are wearing or carrying. Bags and packs that are incorrectly positioned on the wearer will quickly become uncomfortable. Incorrectly adjusted straps on a bag or pack can cause distress and become physically harmful to a user/wearer within a relatively short period of use.

At times, users such as hikers, campers, and military personnel have a need to carry extremely heavy loads containing essential necessities such as gear, food and water. In some instances the wearer will need to carry such gear and necessities significant distances as well as on challenging terrain.

Students and commuters also carry heavy and overloaded packs and bags. Wearers may also have limitations caused by conditioning, age, size of the load being carried in contrast to the size of the wearer, as well as physical infirmities. Carrying even moderately heavy packs and bags can lead to stress and physical injury when loads are carried over significant distances.

The presently disclosed adjustable strap system provides several benefits to the users and wearers by correctly and controllably positioning a pack or bag on the shoulder and torso of the user. Additionally the present adjustable strap system can regularly reposition and readjust the straps so that the user experiences less fatigue from carrying weight supported by straps that are in a single location on the shoulders and torso. The present strap system scientifically determines the optimal shoulder strap location on the human frame that provide more comfort over longer periods of time, with larger loads carried longer distances and with less stress and discomfort to the user.

Bag and backpack manufacturers have provided users with limited solutions. Typically a pack or bag shoulder strap is designed with additional foam and material padding that is expected to provide more comfort to the user. Additionally, manufacturers and other designers have provided more adjustability to the strap by shaping the strap to better fit the human shoulder and torso. All of these methods for providing users with a better method of supporting a bag or pack do not provide an effective means of reducing stress, discomfort and even injury for users.

There are significant benefits to wearing a correctly positioned pack or bag. Straps that automatically adjust based on the needs of an individual user can provider a safer and more comfortable means for carrying loads on the human frame. A backpack or bag that utilizes a series of sensors to gather data about the wearer provides an intelligent means of correctly positioning or mounting the pack or bag straps on the user's shoulder, so the pack or bag can be carried for longer periods of time, with larger loads, for longer distances and with less stress and discomfort.

The presently disclosed carry system provides an superior method of control based on artificial Intelligence (AI). The AI controller of the present system is capable of analyzing real-time user data including the current environment, the user's physical conditioning and changes in terrain, and controlling a series of commands to a plurality of mechanical, fluid and pneumatic mechanisms specifically designed to shift the carried load to different positions on the shoulders, and/or the front and back torso of a user wearing the system.

The presently disclosed system utilizes environmental and health data to optimize the position of the load resulting in less stress on the user. The advantage of users wearing an ergonomically correct strap for a bag or pack provides an efficient and comfortable method of carrying loads on the human frame.

SUMMARY OF THE INVENTION

A wearable carrying system having one or two straps attached to a container to be carried. A bladder system is fixed to one side of the strap, or in a sleeve surrounding the strap, with the bladders being sequentially inflated and compressed by controlling the introduction and removal of a fluid into and from the bladders. The wearable carrying system also includes a sequentially inflatable and deflatable shoulder pad. Force sensors are located on the straps and shoulder pad to generate signals relating to a force exerted on the shoulder or the torso of a user of the wearable carrying system.

BRIEF DESCRIPTION OF THE DRAWINGS

FIG. 5 illustrates a carry strap with internal integrated bladder and artificial intelligence components;

FIGS. 6A and 6B illustrate in a side view and cross-section detail view a carry strap as an added accessory strap combined with an existing shoulder strap and sleeve;

FIG. 20 is a table defining certain data gathered and input to the control method of the presently disclosed system;

FIG. 21 is a table defining some of the data output from the processing unit for the purpose of controlling the strap system;

DESCRIPTION OF THE ILLUSTRATIVE EMBODIMENT

Figure 1:
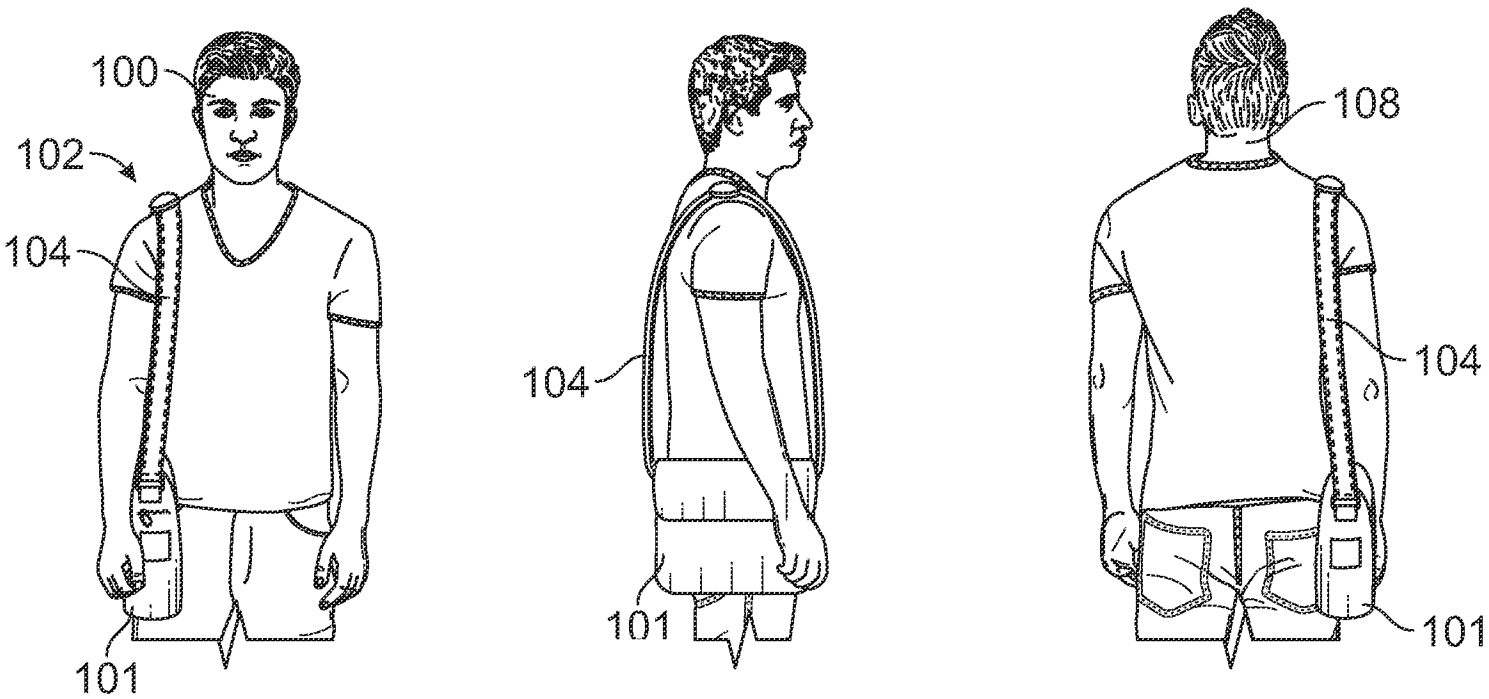
FIG. 1 illustrates the front, side and rear view of a wearable single strap bag carry system worn by a user.

The presently disclosed system is a controllable self-contained carrying and support system that can operate independent of internet, mobile phone or GPS device. The present system is microcontroller based and designed to collect data from a plurality of sensors and other devices. The collected data is then input into an artificial intelligence microcontroller which then analyzes and processes the data. The microcontroller processes data and outputs instructions for the sole purpose of controlling the positioning of the straps, packs and bags. Output instructions then control the straps by shifting the strap, pack and bags, providing a means for adjusting the weight and load on the shoulders and/or torso of the user.

The present system relies on a series of load adjusting bladders and mechanisms that are installed within the shoulder, upper torso and back straps of the user. Control of the straps and mechanisms are managed by an intelligent microcontroller configured to make decisions on positioning and frequently repositioning the users load.

The present system is an automatic and intelligent means of controlling the load, but which load can also be manually or semi-automatically controlled by the user. The system is powered by a replaceable and rechargeable energy source such as a battery that is carried within the pack or bag or worn by the user.

The presently disclosed pack and strap system places a grid of embedded and/or externally mounted sensors on the shoulders and torso area of a wearer/user. A modular self-contained artificial intelligence enabled microcontroller module is attached to the users strap or housed in the packs and bags carried by the user. The module comprises the technology to capture data on the motion of the user and the backpack's load position to analyze stresses imposed on the user's body. Sensors embedded within the fabric of the upper torso and back straps are sampled to gather parametric data in real-time.

Data from the embedded or external sensors are transmitted to a specialized AI microprocessor located in the strap and/or backpack and is synthesized into an internal 3D rendering of the user. Real-time analysis of the user's motion and pack loading is then combined with environmental, terrain, health and fitness data for AI processing.

AI based algorithms reside within the AI module and control decisions on pack load shifting and adjustment. The AI module can shift the load in any direction while the pack is being worn by the user. The result is a load shift that adjusts the load and forces relative to the straps or the pads in the back and front torso of the user.

The AI controller will run independently of mobile phones or WIFI connections and will inflate and deflate a series of pneumatic and hydraulic bladders and/or provide movement to mechanical devices located in the shoulder, strap and back area of the backpack. This actively increases the user's load capacity up to 35% or more, by adjusting the load to an optimal carry position. The result is providing continuous comfort as well as a way of increasing overall user carry performance.

The AI module is configurable using a mobile phone and/or personal computer or a proprietary display. Additionally the AI module can be configured by microphone and voice commands generated by the user.

The present system also utilizes a mobile application or an application that runs on a personal computer or is cloud based.

The present system can be integrated into a newly manufactured backpack or bag, or sold as a single unit with the bag or pack. Additionally, the present system can be an accessory to be used with any pack or bag already owned by users. When configured as an accessory, the present system can also be purchased by a user who is purchasing a new backpack without the present system.

Referring to FIG. 1, 100 depicts a front view of a user wearing a typical single strap container, such as a bag 101 that utilizes the human shoulder for support of the bag. 102 depicts a shoulder strap and pad system and 104 shows the strap 104 extending down from the shoulder on the front side 106 depicts the strap extending down the back side of the wearer. 108 shows the back view of the single strap bag.

Figure 2:
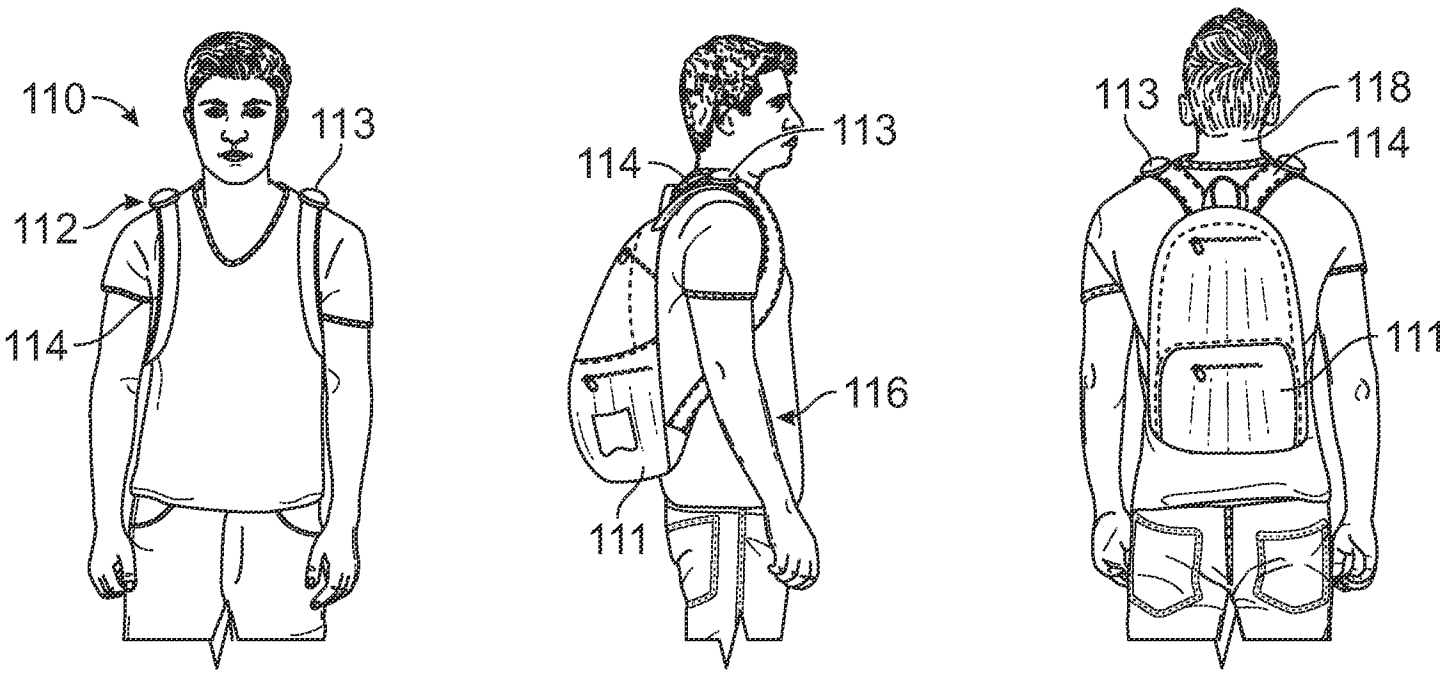
FIG. 2 illustrates the front, side and rear view of a wearable dual strap carry system worn by a user.

In FIG. 2, illustration 110 depicts a front view of a user wearing a typical dual strap container such as bag or backpack 111 utilizing the shoulders on both sides of the wearer for support of the bag. 112 depicts a shoulder pad system 113 that resides on the top of the shoulder. 114 shows the how the straps extend down from the shoulder on the front of the user's torso and 116 shows how the straps typically extend down the side and back of the wearer. Illustration 118 shows the back view of a dual strap bag or pack support system.

Figure 3:
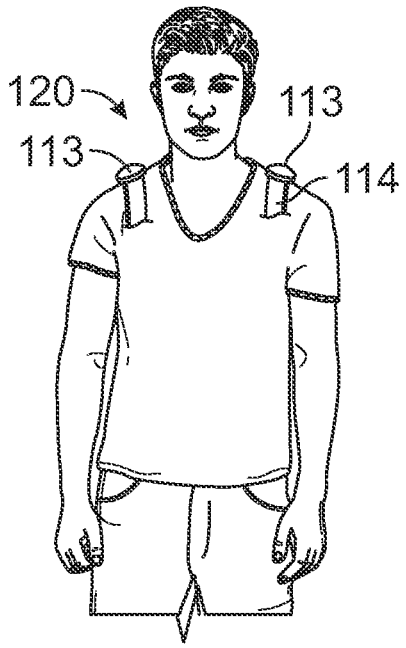
FIG. 3 illustrates the location of the present dual strap system on the shoulders of a user.

In FIG. 3, 120 illustrates the placement of the strap system shoulder pad 113 on the top side of the user's shoulders, integrated and connected to the straps 114.

Figure 4:
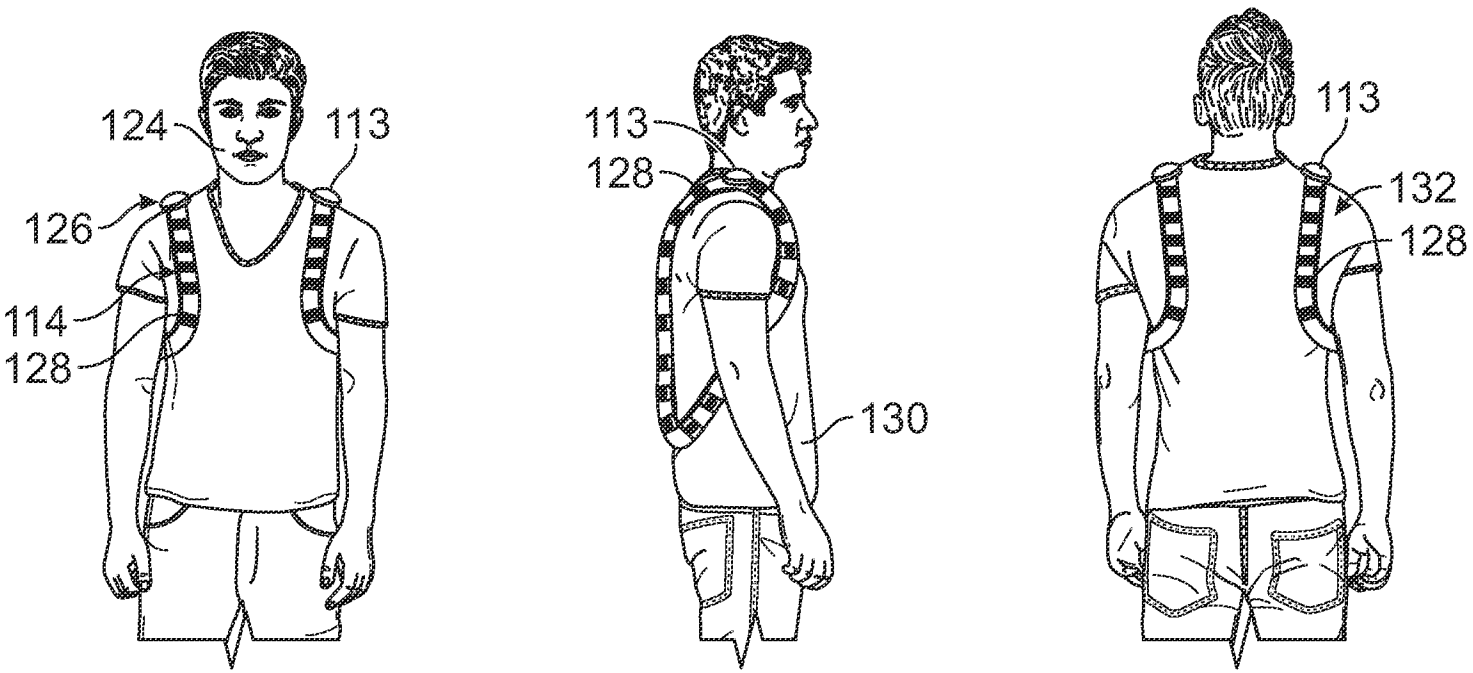
FIG. 4 illustrates the location of the present dual strap system on the front, side and back of the torso of a user.

FIG. 4 illustrates the location of strap system 114 on the front, side and back of the torso of the wearer. Illustration 124 is a front view of the wearer showing the pad 113 located on the user's shoulder top 126. Straps 114 included embedded integrated load adjusting pneumatic and/or hydraulic bladders 128 extending down the front 130 and back 132 straps worn by the user.

FIG. 5 illustrates a carry strap 114 as an original strap with internal integrated load adjustment system 134. 134 shows the shoulder pads 113 located within the strap 114. 136 shows the strap 114 with adjustable bladder mechanisms 115 located inside and throughout the back straps 114 of the strap system.

FIG. 6A illustrates an additive and accessory version of the presently disclosed system which can be adapted to be applied to any existing backpack or bag pack straps. 140 shows the location of the shoulder pad 113 that is located beneath and original and existing strap 142. 144 shows the placement of the mechanized bladders 115 beneath the existing strap 142 to allow adjustment of the strap pressure and loading. FIG. 6B is a cross-section view of the containment sleeve 146 that surrounds and attaches to existing backpack strap 148. Adjustable bladder system 150 is located beneath the original backpack strap 148, and within the containment sleeve 146 that houses both the strap and the original backpack or bag strap 148. 152 shows the sleeve 146 with adjustable bladder mechanisms 150 located inside and throughout the back and front torso straps worn by the user.

Figure 7A:
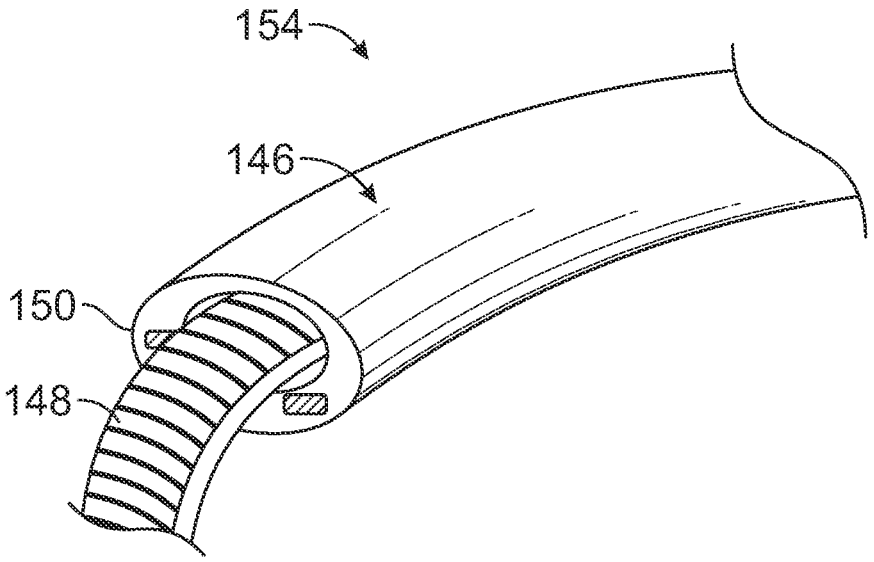
FIGS. 7A and 7B illustrate in partial cross section views the additive carry strap combined with an existing strap and sleeve.
Figure 7B:
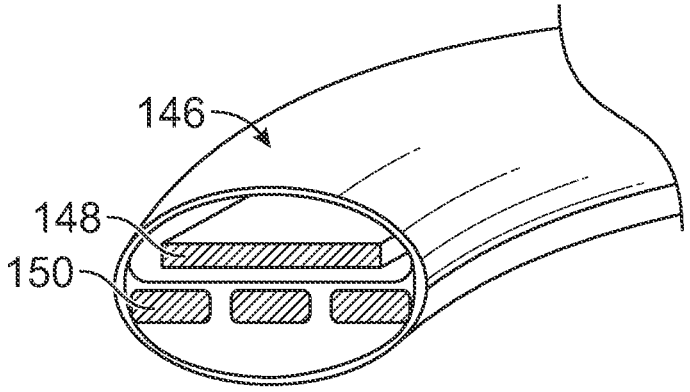

FIGS. 7A and 7B illustrate the additive carry strap added to an existing strap of FIGS. 6A and 6B. 154 is an enlarged inside view of the sleeve 146 surrounding original strap 148. The original backpack or bag strap 148 is shown, as well as a view of the placement of the bladder system 150, shown located beneath the original pack strap 148.

Figure 8A:
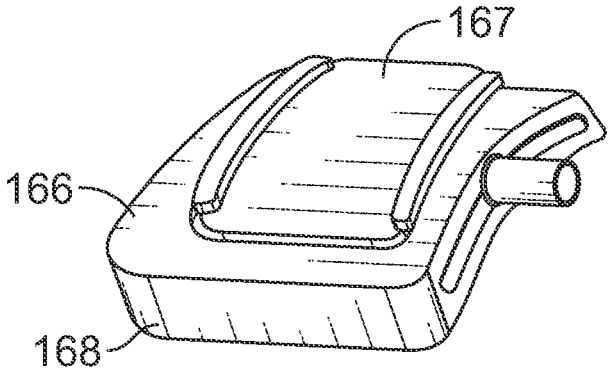
FIGS. 8A, 8B and 8C illustrate the method and device allowing shoulder pad and strap movement by mechanical elements.
Figure 8B:
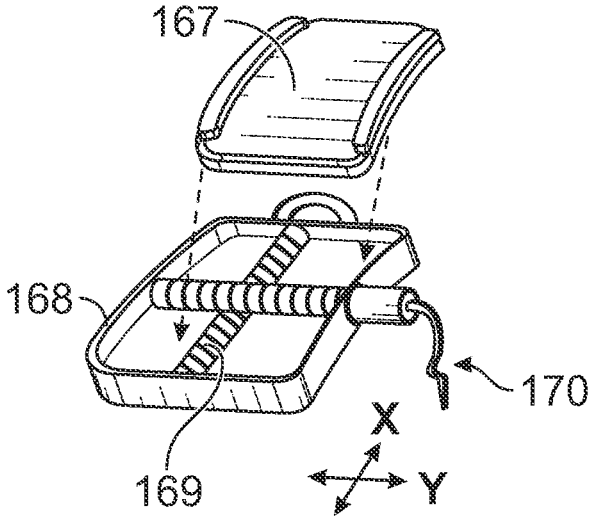
Figure 8C:
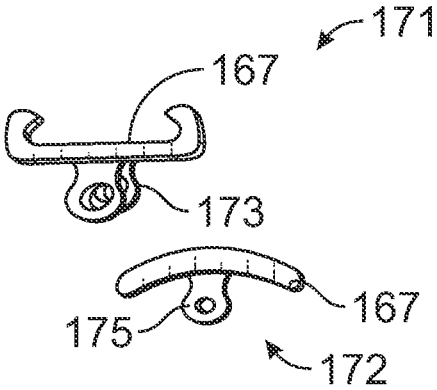

FIGS. 8A-C illustrate the method of strap and torso movement by a mechanical device, where a shoulder mechanism is capable of being moved in multiple directions by means of electromechanical solenoids and/or motors and/or by air pistons or bladders (not shown).

Shoulder pad mechanism 166 is comprised of two primary assemblies. A floating and movable somewhat U-shaped strap containment assembly 167, and a shoulder pad base assembly 168, containing the electromechanical solenoids, motors and gears, and air or hydraulic pistons necessary to control and move the straps under load conditions (FIG. 8B).

The movement of the backpack or bag straps is achieved by inputting electrical signals on wires 170, to motors, solenoids, pistons and/or gears 169, located within the shoulder pad base assembly 168, providing a means for repositioning the strap load by moving the strap(s) to a different location in an X or Y direction on the user's shoulders.

169 shows the location of gears and/or bladders within the shoulder pad base assembly 168, that move the strap containment assembly 167 in the X and Y directions. Movement of the strap containment assembly 167, either forward towards the wearer's front torso or backwards towards the user's back torso or sideways in the direction of the user's neck or arm, provides a means of shifting the load or weight on the user's shoulders.

FIG. 8C shows at 171 a front cross-section view of the strap containment assembly 167 with an attachment device 175 providing for a means for movement and connection to the shoulder pad base assembly 168. 172 is a side view of the strap containment 167, with an attachment area beneath it providing for a means for movement of and connection to the shoulder pad base assembly 168.

Figure 9:
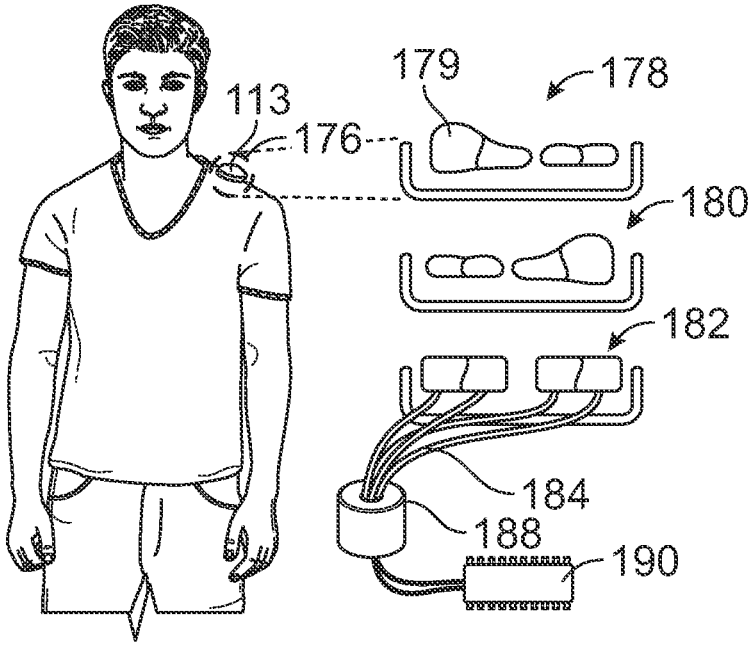
FIG. 9 illustrates the method of strap and torso movement of gas-based pneumatic elements.

FIG. 9 illustrates a method of strap movement incorporating a gas based pneumatic system. 176 depicts where the shoulder pad 113 is located. Illustration 178 is a cross-section view of a mechanized pneumatic bladder system 179 for utilizing gas such as air for the inflation and deflation of the bladder 179, which in turn will allow weight and location adjustment of the bag or backpack. Illustration 178 shows a multi bladder system with an increased inflation of one of the bladders 179. Illustration 180 shows a different bladder inflation and deflation level as does illustration 182. The bladders are connected by multiple tubes 184, leading from an air pump 188, powered by a battery 190.

Figure 10:
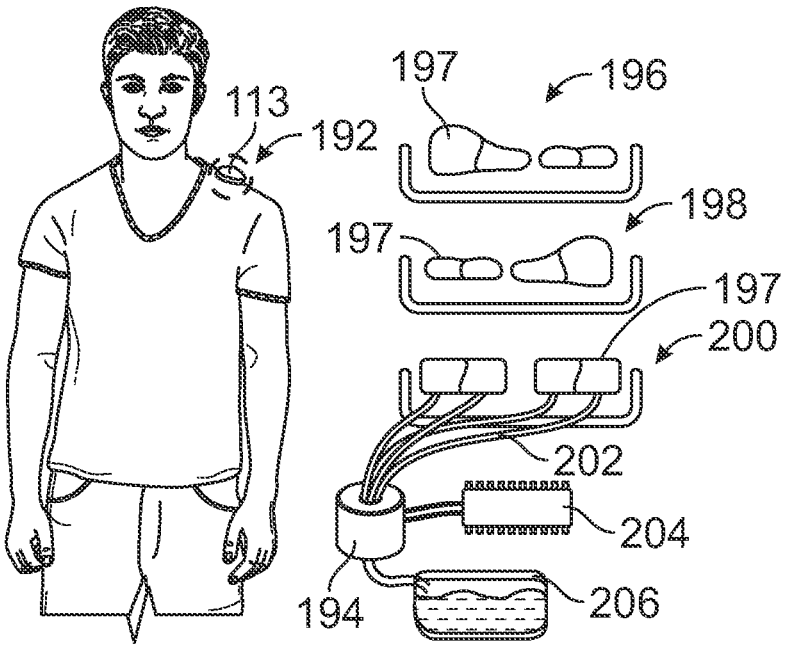
FIG. 10 illustrates the method of strap movement by liquid hydraulic elements.

FIG. 10 illustrates the method of strap movement incorporating a liquid hydraulic system. 192 depicts the where shoulder pad 113 is located. 196 is an inside cross-section view of an mechanized hydraulic bladder system 179 for utilizing liquids such as water for the inflation and deflation of the bladder 179, which in turn will allow weight and location adjustment of the bag or backpack. Illustration 196 shows a multi-bladder system with an increased inflation of the bladders. Illustration 198 shows a different bladder inflation and deflation level as does illustration 200. The bladders are connected by multiple tubes 202, leading from a hydraulic pump 194, powered by a battery 204. A reservoir 200 provides for containment of the liquids used in the hydraulic system 197.

Figure 11:
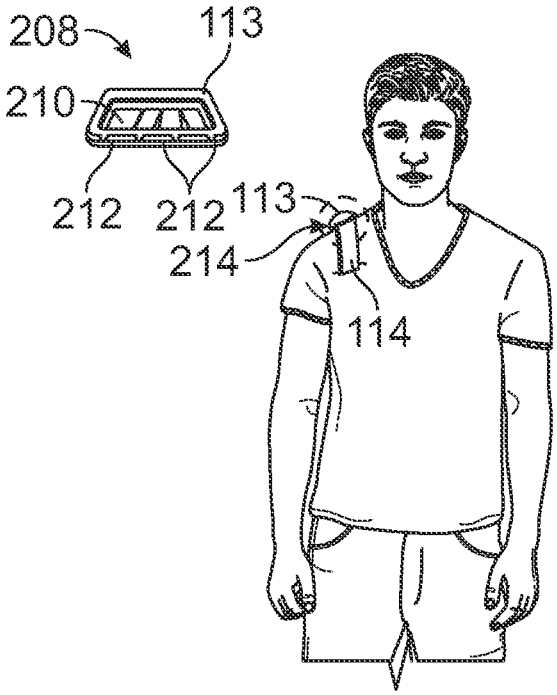
FIG. 11 illustrates the placement of sensors on the shoulder areas of a shoulder pad.

FIG. 11 illustrates the placement of sensors on the shoulder areas of the user. 214 is a depiction showing the shoulder location of the pad 113. Enlarged view 208 of the pad 113 shows the internal primary components, including bladder 210 and the solenoid motorized strap movement mechanism (not shown). A sensor grid 212 which determines the force being exerted on the wearer, based on the location of the backpack or bag strap. The sensor grid 212 measures the exact force over a large area of the shoulder providing data to the artificial intelligence system for analysis, recommendations and adjustments to the straps 114 and pads 113 of the backpack or bag.

Figure 12:
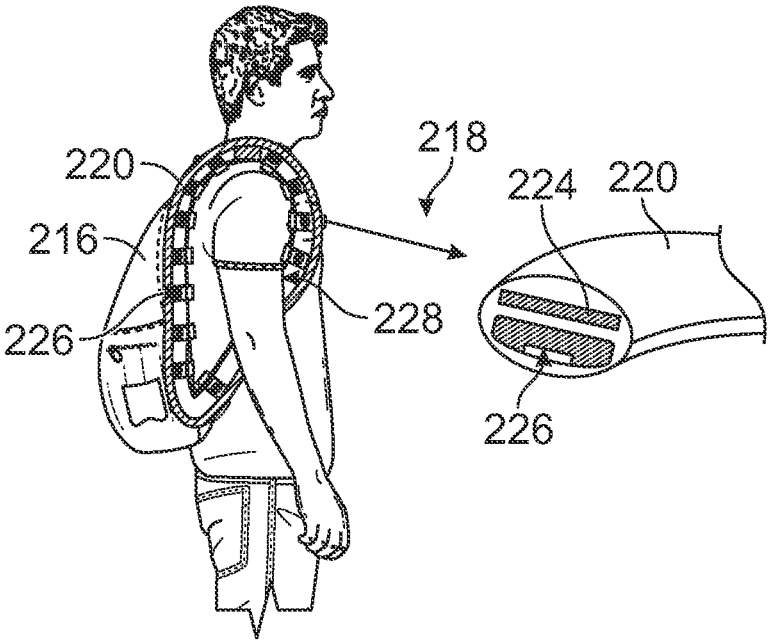
FIG. 12 illustrates the placement of a strap's sensors on the front and back torso areas of a user.

FIG. 12 illustrates the placement of force sensors 226 on the front and back torso strap areas of the user. 216 shows the location of force sensors 226 and other sensors located within the back torso strap and the front torso strap 228. 218 shows a detailed enlarged view of the strap 220 with the placement of the sensors 226 beneath the bladder mechanisms 224 within the strap.

Figure 13:
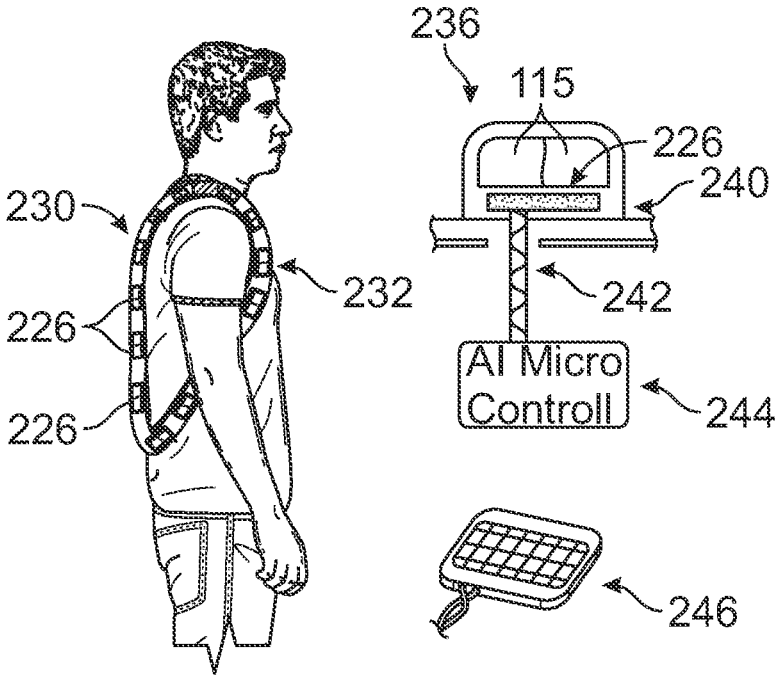
FIG. 13 illustrates the placement of sensors on the chest and back areas of a strap.

FIG. 13 illustrates by a side view the placement of sensors 226 on the back 230 of the torso of the wearer as well as the front torso 232. 236 is an enlarged detail view of the sensors 226 placed adjacent the chest and back of the user. Sensor 227 grids are placed beneath bladders 115 and on top of the user's chest and back torso 240 areas. Data from sensors 226 is inputted at 242 into the microcontroller 244 for processing. Illustration 246 shows a sensor grid 226 that is placed adjacent the chest and back location on top of the torso 240.

Figure 14:
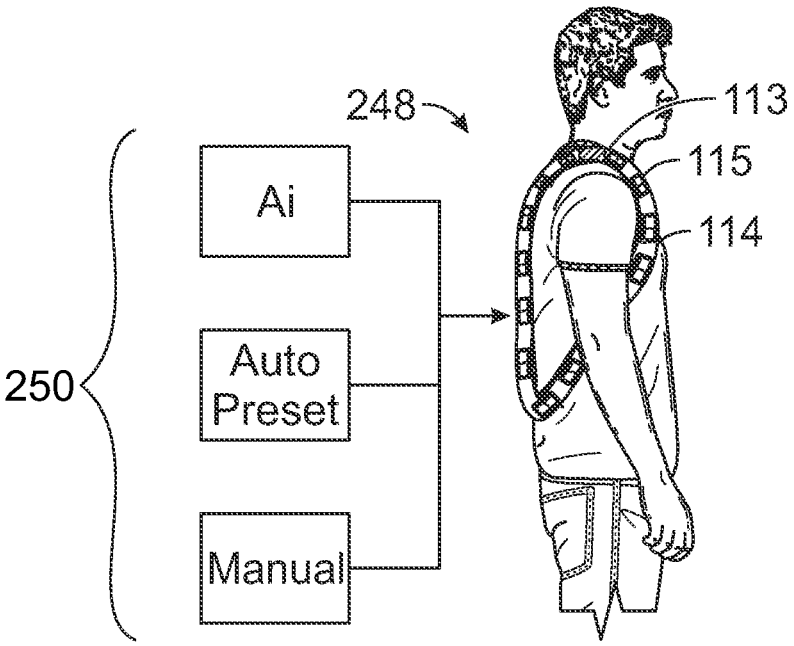
FIG. 14 illustrates another method of controlling strap movement utilizing the presently disclosed system.

FIG. 14 illustrates another method of controlling strap movement utilizing the presently disclosed system. 248 shows the three basic methods by which the mechanized bladders 115 for straps 114 and pads 113 are controlled. The three primary methods for control are: artificial intelligence processed data; automatic presets for cycling load movements; and manual user selected modes for movement of strap and shoulder pad loads.

Figure 15:
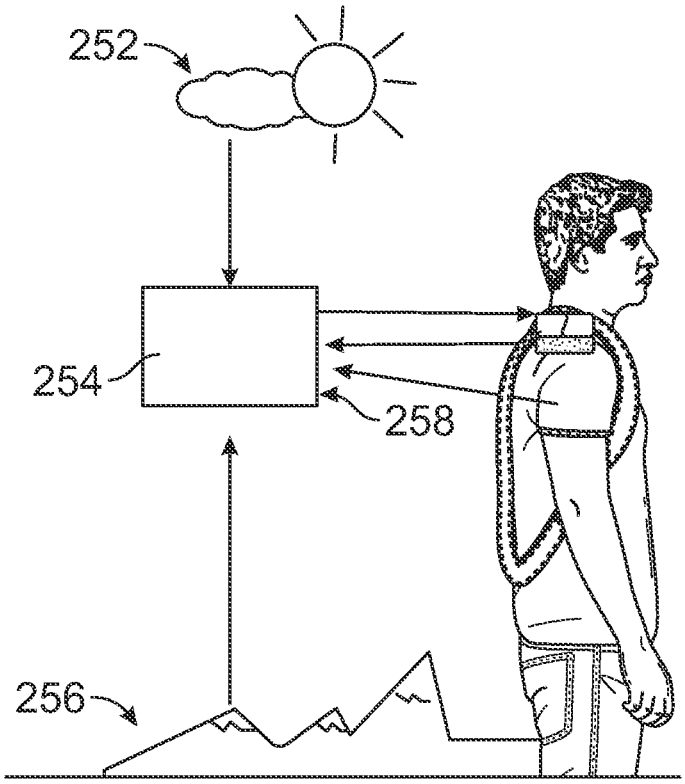
FIG. 15 schematically illustrates the automatic control of the presently disclosed strap system incorporating artificial intelligence.

FIG. 15 schematically illustrates automatic control of the presently disclosed strap system by means artificial intelligence. Ambient factors 252, human factors 258, and journey related factors 256 are processed by microcontroller 254 and the artificial intelligence system.

Figure 16:
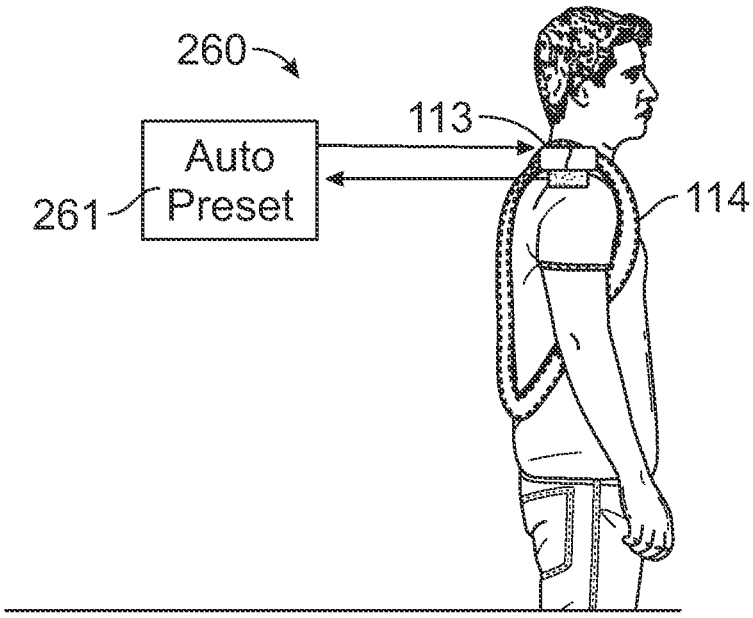
FIG. 16 illustrates the automatic control of the presently disclosed strap system by automated, predictive, and predetermined systems.

FIG. 16 schematically illustrates the control of the disclosed strap system automatically by automated, predictive, and predetermined processes. Illustration 260 depicts the control of pads 113 and straps 114 by means of preset program cycles 261 that would provide the user a means for automatic scheduled intervals for adjustment of straps 114 and pads 113.

Figure 17:
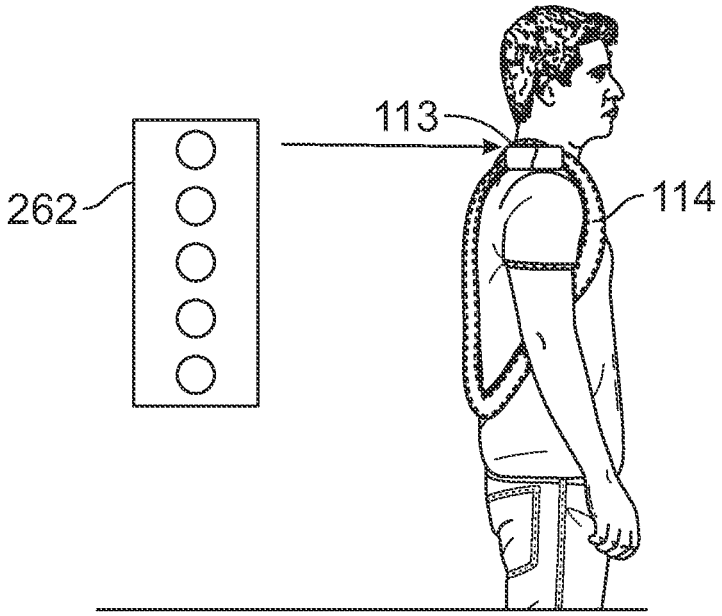
FIG. 17 illustrates the control of the presently disclosed strap system utilizing a manual, user-controlled switch system.

FIG. 17 schematically illustrates control of the disclosed strap system utilizing a manual, user-controlled switch system 262. A series of switches comprising switch system 262 provides the user with a simple and effective means for manually initiating and executing the adjustment of straps 115 and pads 113.

Figure 18:
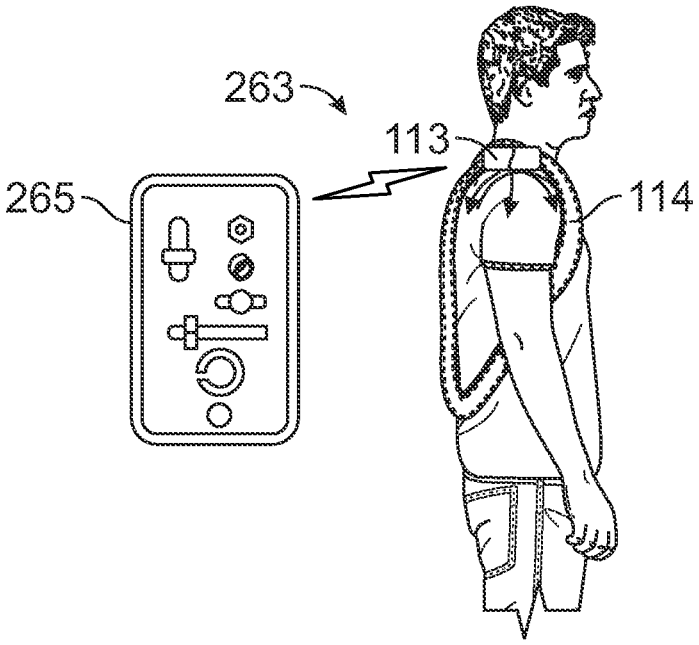
FIG. 18 illustrates the control of the presently disclosed strap system by an application installed on a user's mobile phone.

FIG. 18 schematically illustrates the control of the disclosed strap system using a mobile application installed on user's phone. 263 depicts the control of pads 113 and strap 114 by means of a mobile phone 265, either connected by cable or by a wireless radio frequency connection such as Bluetooth®.

Figure 19:
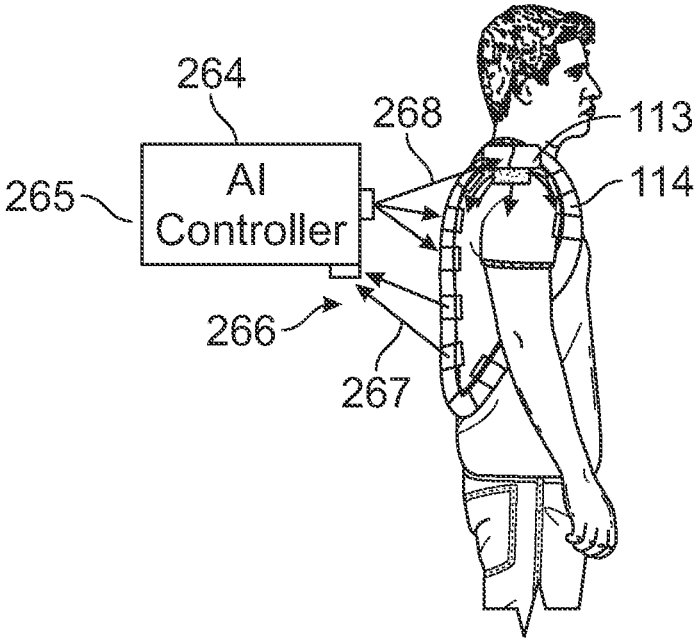
FIG. 19 is a schematic illustration of an artificial intelligence control system.

FIG. 19 schematically illustrates an artificial intelligence control method. An artificial intelligence (AI) based microcontroller 264 is self-contained and housed within the backpack 111 or bag 101. The AI microcontroller 264 is the primary means of intelligent control of the straps 114, pads 113 and other load areas of the backpack or bag. The present system is not dependent on any outside data input from mobile phones or the internet/cloud. The system resides within the backpack 111 or bag 101 and the straps 114 and pads 113 associated with the system. The AI microcontroller 264 provides all of the load shifting strategy and occurrences based on intelligent data factors gathered by the local system sensors 226. Upon system initialization, the user will input personal data. Additionally the system will continuously gather information from previous outings, hikes, wear, and other performance monitored data. Illustration 266 depicts sensor data 267 being input into the AI microcontroller 264, and data 268 being output to the load shifting mechanisms on of the backpacks, bags and the straps and pads attached to them.

FIG. 20 is a table defining certain of the data generated and input to the artificial intelligence control method of the presently disclosed system. The chart of FIG. 20 details some of the primary data that the artificial intelligence system utilizes for data processing.

FIG. 21 is a chart defining certain of the data output from the artificial intelligence processing unit for the purpose of controlling the strap 114 system. FIG. 21 provides details of some of the primary control functionality that the artificial intelligence system outputs to instruct and control all electro-mechanical, hydraulic and pneumatic load adjustments of the disclosed system.

Figure 22:
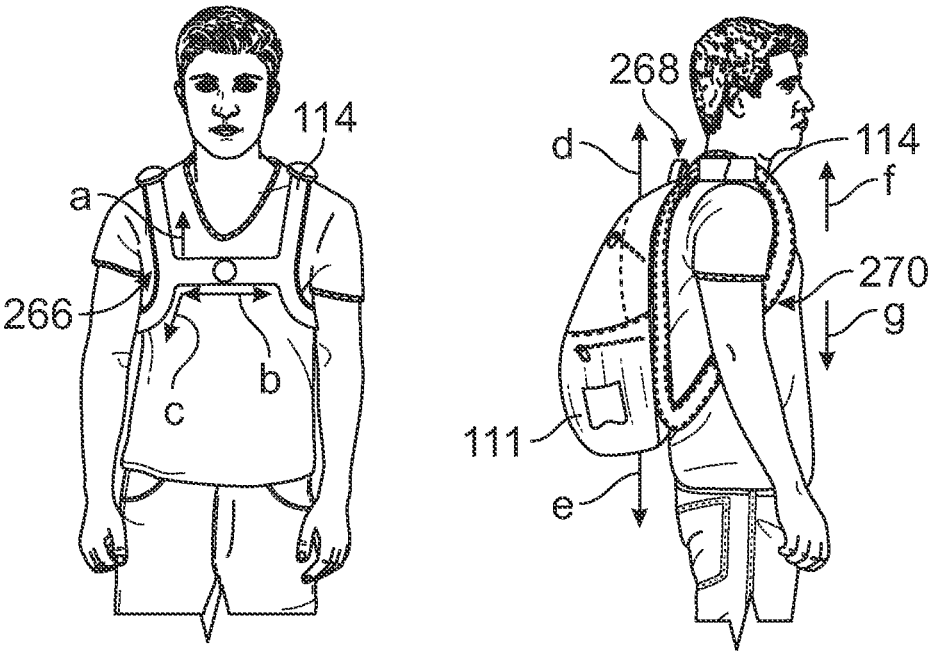
FIG. 22 illustrates an additional control of a back-mounted system that adjusts the load carried on the back of a wearer.

FIG. 22 illustrates additional control of a back mounted support system that utilizes the presently disclosed strap system to additionally adjust the load carried on the back of a user. 266 and arrows a, b and c depict the additional load and fit adjustments controlled on the front torso and chest area of the user. Form and fit adjustments help adjust the straps 114 and packs 111 to an ideal position to compensate for varying body sizes as well as areas involving chest, waist, and hips of the wearer. Illustration 268 shows AI and automatic controlled pack height adjustments d, e, f and g to assist with proper fit and loading. 270 shows areas of the front torso that can be adjusted by means of AI or automatic control.

Figure 23:
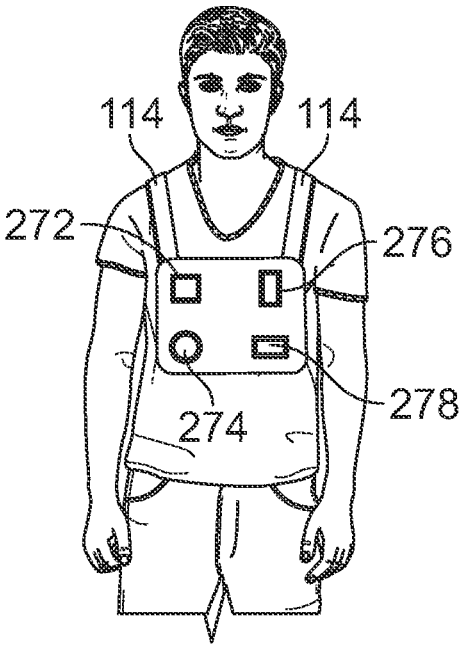
FIG. 23 illustrates the connection of the presently disclosed strap system to a battery power source and to a microcontroller located in the strap or in the bag or pack being carried.

FIG. 23 illustrates the connection of the strap 114 to a battery power source and to the microcontroller located in the strap or the bag or pack being carried. A self-contained back or bag 272 contains all of the components needed for AI control of the bag or pack. AI microcontroller 274 is electronically connected to battery 276 to power the system. A liquid reservoir housing 278 contains the hydraulic/liquids, and pneumatic/compressed air used to operate the disclosed system.

We claim:

1. A wearable carrying system comprising:

a wearable container;

at least one strap attached to the container, the at least one strap including at least one bladder fixed to one side of the strap, the at least one bladder configured to be sequentially inflated and compressed by the controllable introduction and removal of a fluid into and from the at least one bladder;

a shoulder pad located on a portion of the at least one strap, the shoulder pad adapted to be disposed on the shoulder of a user when the carrying system is worn by a user;

the shoulder pad further comprising:

a shoulder pad base assembly including a chamber within the shoulder pad base assembly; and a controllable mechanical movement system located in the chamber within the shoulder pad base assembly, the mechanical movement system operatively connected to a strap containment assembly, the mechanical movement system selectively moving the strap containment assembly in at least one of an X or Y direction relative to the shoulder pad base assembly.

2. The wearable carrying system of claim 1, wherein the fluid is one of a gas or a liquid.

3. The wearable carrying system of claim 1, wherein:

the shoulder pad includes at least one additional bladder configured to be sequentially inflated and compressed by the controllable introduction and removal of a fluid into and out of the additional bladder.

4. The wearable carrying system of claim 3, further including:

at least one sensor located in the shoulder pad, the at least one sensor located between the additional bladder and a bottom surface of the shoulder pad, the at least one sensor adapted to generate at least one signal relating to a force exerted on a shoulder of a user by the wearable carrying system.

5. The wearable carrying system of claim 1, further including:

at least one force sensor mounted on the at least one strap, the at least one force sensor configured to generate at least one signal relating to a force exerted on the torso of a user by the wearable strap system.

* * * * *